US005776084A

United States Patent [19]

Wolan

[11] Patent Number: 5,776,084

[45] Date of Patent: Jul. 7, 1998

[54] POWERED MUSCLE REHABILITATION DEVICE

[76] Inventor: Edward Wolan, 1500 Bay Rd., Apartment L25, Miami Beach, Fla. 33139

[21] Appl. No.: 726,691

[22] Filed: Oct. 7, 1996

[51] Int. Cl.[6] ..... A61H 1/00; A63B 21/008

[52] U.S. Cl. ..... 601/26; 482/111

[58] Field of Search ..... 601/23, 24, 25, 601/26; 482/111

[56] References Cited

U.S. PATENT DOCUMENTS

| | | | |
|---|---|---|---|
| 3,674,017 | 7/1972 | Stefani | 601/26 |
| 4,444,390 | 4/1984 | Erickson . | |
| 4,448,412 | 5/1984 | Brentham . | |
| 4,465,274 | 8/1984 | Davenport . | |
| 4,509,745 | 4/1985 | Angsten . | |
| 4,566,692 | 1/1986 | Brentham . | |
| 4,667,995 | 5/1987 | Giesch . | |
| 4,691,694 | 9/1987 | Boyd et al. | 128/25 |
| 4,725,056 | 2/1988 | Rehrl | 601/23 X |
| 4,750,735 | 6/1988 | Furgerson et al. . | |
| 4,802,462 | 2/1989 | Reiss et al. | 128/25 |
| 4,827,913 | 5/1989 | Parker | 601/26 |
| 4,858,919 | 8/1989 | Jones | 601/24 X |
| 4,860,763 | 8/1989 | Schminke | 128/707 |
| 4,981,199 | 1/1991 | Tsai . | |
| 5,070,863 | 12/1991 | McArthur | 601/26 |
| 5,169,361 | 12/1992 | Hsu . | |
| 5,320,641 | 6/1994 | Riddle | 601/24 X |
| 5,458,618 | 10/1995 | Steinke | 606/242 |

*Primary Examiner*—Richard J. Apley
*Assistant Examiner*—William LaMarca
*Attorney, Agent, or Firm*—Terrance L. Siemens

[57] ABSTRACT

A machine for rehabilitating and exercising the lower back. The machine includes a stationary seat having an adjustably positioned footrest, and a pivotally mounted seatback. The seatback has adjustably positioned handgrips and a dead man switch. A motorized hydraulic system moves the seatback to incline forwardly from the vertical, and to return to the vertical. The degree of pivot is adjustable. A pelvic restraint secures the user'sbody in operative position, so that all work must be performed by the back. A strain gauge provides an input to a microprocessor, which in turn activates a display indicating effort. The hydraulic system is powered so as to move the body either in the absence of muscular resistance and in the presence of even maximal resistance.

18 Claims, 6 Drawing Sheets

POWERED MUSCLE REHABILITATION DEVICE

BACKGROUND OF THE INVENTION

1. Field of the Invention

The present invention relates to a machine for rehabilitating and developing the body by exercising lower back muscles. The machine is attached to the user's limbs, and automatically moves the limbs according to a predetermined routine. The user selectively resists the automatic motions, thereby developing the affected muscles. The invention is also usable in restoring diminished or lost use or ability of muscles due to some disfunction, by conditioning the same according to the aforementioned routine. In the latter situation, the user does not resist the motions, but benefits by forcing the muscles to move through the predetermined routine. As function is restored, the user may elect to exert resistance to the routine, thus improving muscle strength.

The machine comprises a seat for the user, a forwardly inclining seatback, and a motorized hydraulic system for powering the seatback through its travel.

2. Description of the Prior Art

Lower back problems have long been a hindrance to the ability of people to work and even to walk about. Such problems can stem from overexertion and from incorrect lifting techniques. For example, there is a natural tendency of persons lifting large or heavy objects to bend over at the waist and thereby impose much of the load on the lower back. By contrast, recommended practice is to squat, thereby imposing the load on the legs. Regardless of the source of strain to the lower back, many temporary and potentially permanent disabilities result from lower back problems. The end result of such back problems is at the least, discomfort to the individual sufferer, and also a significant loss to the economy in attendant medical costs and lost work time.

There are at least two approaches to addressing this problem. The proactive approach is to encourage strength and stamina in this area of the body, where these characteristics are initially inadequate. A reactive approach is to provide appropriate therapy for the lower back once it has been strained.

Machines for accomplishing conditioning and rehabilitative therapy have been proposed in the prior art. A brochure titled "Specific Testing For Spinal Evaluation", published by MedX Corporation of Ocala, Fla., dated 1991, illustrates evaluation and rehabilitation equipment bearing certain surface similarities to the present invention. The subject equipment has a seat, hand holds, and leg restraints generally similar to corresponding members of the present invention.

Components of the MedX equipment and representative motions of a user are diagrammatically illustrated in "New Approach to Low Back Evaluation and Training", an article published in Central Florida Physician in July, 1989.

However, unlike the present invention, this equipment is not described as having apparatus for moving the user's body through a predetermined motion regardless of muscular exertion by the user. This characteristic in the present invention leads to ability to rehabilitate greatly incapacitated patients.

U.S. Pat. No. 4,566,692, issued to Jerry D. Brentham on Jan. 28, 1986, describes an exercise device wherein the user sits thereon and moves certain levers against a resistance. Pressure and position sensors generate signals processed by a microprocessor, which derives values indicative of muscular effort. These values are displayed on a visual display.

This invention incorporates a hydraulic system having adjustable restriction for varying motion of the machine. However, unlike the present invention, Brentham's invention lacks structure for accommodating necessary constraints to and motion of a user's body for causing rehabilitative movement appropriate for lower back conditioning and therapy.

None of the above inventions, taken either singly or in combination, is seen to describe the instant invention as claimed.

SUMMARY OF THE INVENTION

Machines for developing the body have long been available for muscular development purposes. A particular area of the body which would benefit people for ordinary activities unrelated to general muscular development is the lower back. It is estimated that many people become injured each year in the course of engaging in lifting tasks and the like, both during work and at other times. This situation requires rehabilitation for those already incapacitated by this type of injury. However, a preemptive measure reducing likelihood of this frequent type of injury is to provide conditioning exercises specifically designed to develop the lower back muscles. The present invention answers both aspects of lower back problems.

In a departure from prior art philosophies, in which the machine either passively or actively resisted movement exerted by the user's body, the present invention can be employed selectively to operate in conventional fashion, wherein the user resists the machine, or alternatively may compel the body to move through a predetermined motion. The latter choice is a therapeutic technique for assisting in restoring lost function to the body. Lost function may arise from lower back injury due to overexertion, an impact during an accident, disease, and from still other causes.

To these ends, the apparatus comprises a fixed seat and footrest, and pivotally mounted seatback and headrest, the latter two items formed as a unitary movable assembly. The movable assembly includes handgrips fixed thereto. Distance between the footrest and seat, and position of the handgrips relative to the seat are adjustable to suit bodily dimensions, but both are fixed after adjustments are finalized.

The movable assembly is reversibly powered by a hydraulic circuit having motor, pump, hoses, and appropriate valves and controls. Motion of the movable assembly is oscillatory about the axis of the user's hip joints. The hydraulic circuit pushes the handhold and seatback forwardly, so that the torso is inclined relative to a horizontal position, then reverses, thereby returning the torso to a vertical position.

A strain gauge monitors pressure developed against the backrest of the seat. The strain gauge sends a signal indicative of sensed pressure to a microprocessor. Alternatively, a second gauge may monitor pressure developed within the hydraulic circuit, for inferring muscular effort of resistance by the user. Preferably, the gauge associated with the hydraulic circuit has a transducer for generating a signal which is transmitted to a microprocessor. The microprocessor is connected to a display for communicating performance calculations. Other parameters, such as distance over which force is applied, number of exercise repetitions, and passage of real time, may also be recorded by appropriate apparatus, this data being supplied to the microprocessor. Performance calculations based on monitored parameters may then be inferred. Examples include total resisting force, stamina and improvement thereof over time, and strength and improvement thereof over time.

Two modes of use are possible. In a conditioning exercise, the user vigorously resists motions of the movable assembly. This exertion of muscular effort exercises the lower back muscles. In a rehabilitation mode, active resistance is attempted by the user, but is minimal or ineffectual. The machine merely moves the body through motions which may be impossible on a voluntary basis. The novel machine enables adjustment for the individual user in that any degree of muscular resistance may be exerted, and the path of motion may be adjusted.

It is possible to vary resistance according to individual ability or disability for therapeutic or rehabilitative purposes. In this instance, some resistance is attempted by the user, although the machine will overcome this resistance and still compel the user to move through the predetermined arcuate path. This is a desirable attribute since the body is compelled along the arcuate path, thereby causing muscles to move throughout the entire range of motion. At the same time, effort of resistance is discretionary. A user can vary resistive effort from nominal to maximal, depending upon his ability at the moment. This enables the user to optimize benefits accruing from the exercise. The exercising and rehabilitative regimen continues without requiring further adjustment.

Additionally, resistance may be exerted in both directions. Resistance, if exerted in a direction drawing the upper torso forwardly instead of backwardly, would condition abdominal muscles or other back muscles. This may be performed in addition to other conditioning exercises.

The angular extent of the arcuate path of the movable assembly is limited by controls. This feature enables adjustment for a path of bodily motion that is suited for each individual user.

The speed of the machine is also controlled, although speed of forward and backward motion are constant once adjusted. This is beneficial since most people have a tendency to rush through exercises, thereby diminishing effectiveness thereof.

In the event that a user suffers extreme pain, or encounters any other problem forcing him or her to relax grip of the machine, a dead man switch built in to the handgrip will immediately stop the machine.

In use, a therapist determines desirable characteristics of the workout regimen for each user. The therapist refers to the gauge as well as to comments from the user in order to establish speed adjustment, angular limits of travel of the movable portion of the machine, number of repetitions of each exercise, and the like.

A pelvic restraining belt is tightened about the user immediately prior to use. This belt maintains the hips aligned with the oscillatory axis described prior. The tightening mechanism for this belt feeds and retracts the belts symmetrically from right and left sides, so that the user's body is not twisted when the belt is tightened.

A knee restraint is also provided for preventing the legs from buckling during the exercise. The leg is maintained straight, and disposed generally horizontally.

Of course, the same principles may be applied for other muscle groups. For example, the device may be modified to provide exercise for the biceps. Generally, this type of device is useful for exercising muscles associated with pivoting body members, such as the forearm as it pivots with respect to the elbow and the torso as it pivots at the hips.

Accordingly, it is a principal object of the invention to provide an exercise and rehabilitation machine for improving muscles associated with pivoting body members.

It is another object of the invention to provide a machine which compels the user through an arcuate path of bodily motion, such as inclining the torso relative to the pelvis.

It is a further object of the invention to adjust speed and angular extent of motion of the machine.

Still another object of the invention is to enable muscular effort to be sensed and displayed by the novel machine.

An additional object of the invention is to restrain the legs so that resistive effort is exerted by the lower back muscles or abdominal muscles.

It is again an object of the invention to assure that the torso and pelvis are not twisted when being restrained.

Yet another object of the invention is to enable immediate stoppage of the novel machine should a user lose ability to maintain grasp of the handgrips.

It is an object of the invention to provide improved elements and arrangements thereof in an apparatus for the purposes described which is inexpensive, dependable and fully effective in accomplishing its intended purposes.

These and other objects of the invention will become apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
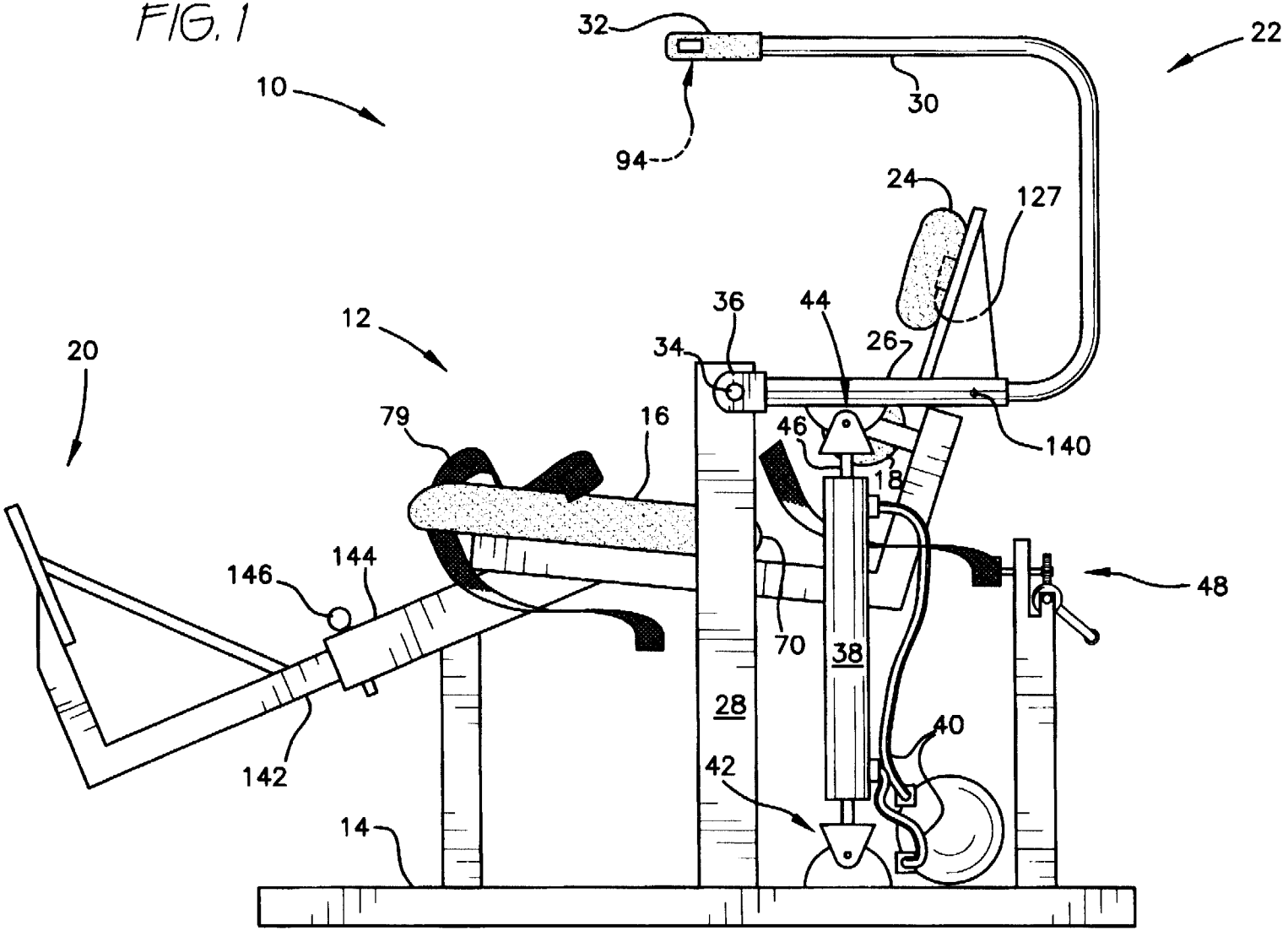
FIG. 1 is a left side elevational view of the invention, with some minor components omitted for clarity.

FIG. 1 of the drawings shows novel conditioning machine 10 having the general form of a chair in which a user (not shown) sits with his or her legs extending forwardly, and with his or her torso oriented in a generally vertical direction initially. Machine 10 has stationary components which remain in a constant, fixed position relative to the floor on which machine 10 is mounted, and moving components which move relative to the stationary components. The stationary components include a seat assembly 12 having a frame including a base 14 for floor mounting, a chair including a chair cushion 16 and a lower back cushion 18, and a footrest 20. The frame comprises fixed structural members connecting and supporting seat assembly 12, base 14, and members providing anchorage for other components which will be described hereinafter. Precise arrangement of the frame is not critical, provided it does not interfere with operation of machine 10.

The significant moving components include a seatback assembly 22 incorporating seatback cushion 24, support arm 26 pivotally mounted to a stationary post 28, projecting upwardly from base 14 and an armrest assembly comprising arm 30 and handgrip 32. Post 28 is, of course, secured to base 14 or to any fixed part of the stationary frame. Seatback assembly anchors to post 28 at pivot point or axle 34 by clevis 36.

Seatback assembly 22 is, of course, generally bilaterally symmetrical, having generally mirror image right and left sides. Therefore, it will be understood that there are right and left clevises 36, right and left arms 26, right and left arms 30, and right and left handgrips 32.

A powered drive in the form of a hydraulic system powers seatback assembly 22 through a path oscillating about axle 34. Visible in FIG. 1 are a hydraulic ram assembly 38 and two fluid hoses 40 supplying hydraulic fluid under pressure to ram 38. Preferably, ram 38 is double acting, in the sense of having an internal piston (not shown) responding to fluid in opposing directions. This avoids the necessity of providing separate rams, although plural rams could be provided if desired.

Ram 38 is pivotally anchored to base 14 at clevis 42 and to seatback assembly 22 at clevis 44. Ram 38 is thus disposed proximate and generally parallel to post 28. As depicted in this view, hydraulic pressure will cause the piston of ram 38 to move upwardly, thereby causing seatback assembly 22 to rotate in a counterclockwise direction. It is this motion which is resisted by the user in the active exercising mode. In the rehabilitative mode, the user exerts little or no conscious resistance, relying instead upon stretching of the lower back muscles for therapeutic effect. It should be noted that the torso of the user is compelled by the superior power of the powered drive to incline pivotally in a forward direction from a seated position regardless of resistance applied by the user. Therefore, muscular resistance occurs not merely under static conditions, but occurs throughout a range of bodily motion.

Figure 2:
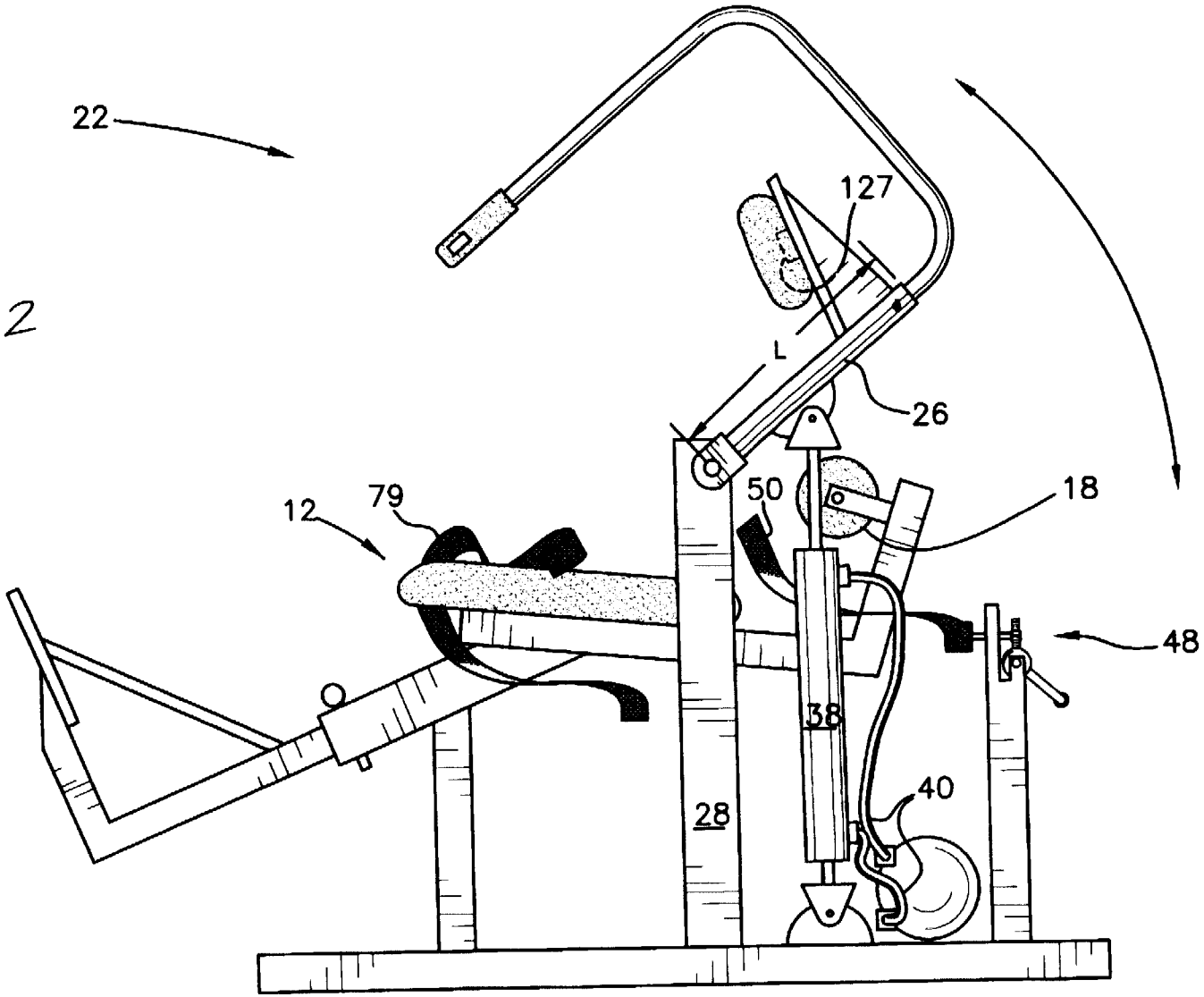
FIG. 2 is a side elevational detail view showing the principal moving parts of the invention and stationary structural members supporting the principal moving parts.

FIG. 2 illustrates inclination of seatback assembly 22, showing a representative maximal range of path of travel thereof. It will be seen that ram 38 inclines somewhat as it pivots at points 42 and 44 to accommodate this inclination. Arm 30 bends upwardly above cushion 24, so that handgrip 32 is located above seatback assembly 22 at at least one point during full inclination to a location above the user's head.

Also shown in FIG. 2 is a seatbelt assembly 48 anchored to seat assembly 12. A flexible seatbelt 50 is shown projecting from seatbelt assembly 48 in the position belt 50 would assume if engaging the pelvis of a user. The pelvis of the user is entrapped between seatbelt 50 and lower back cushion 18 fixed to seat assembly 12. Entrapment of the pelvis assures that the lower back will be exercised rather than the legs when resistance is offered to inclination of seatback assembly 22.

Figure 3:
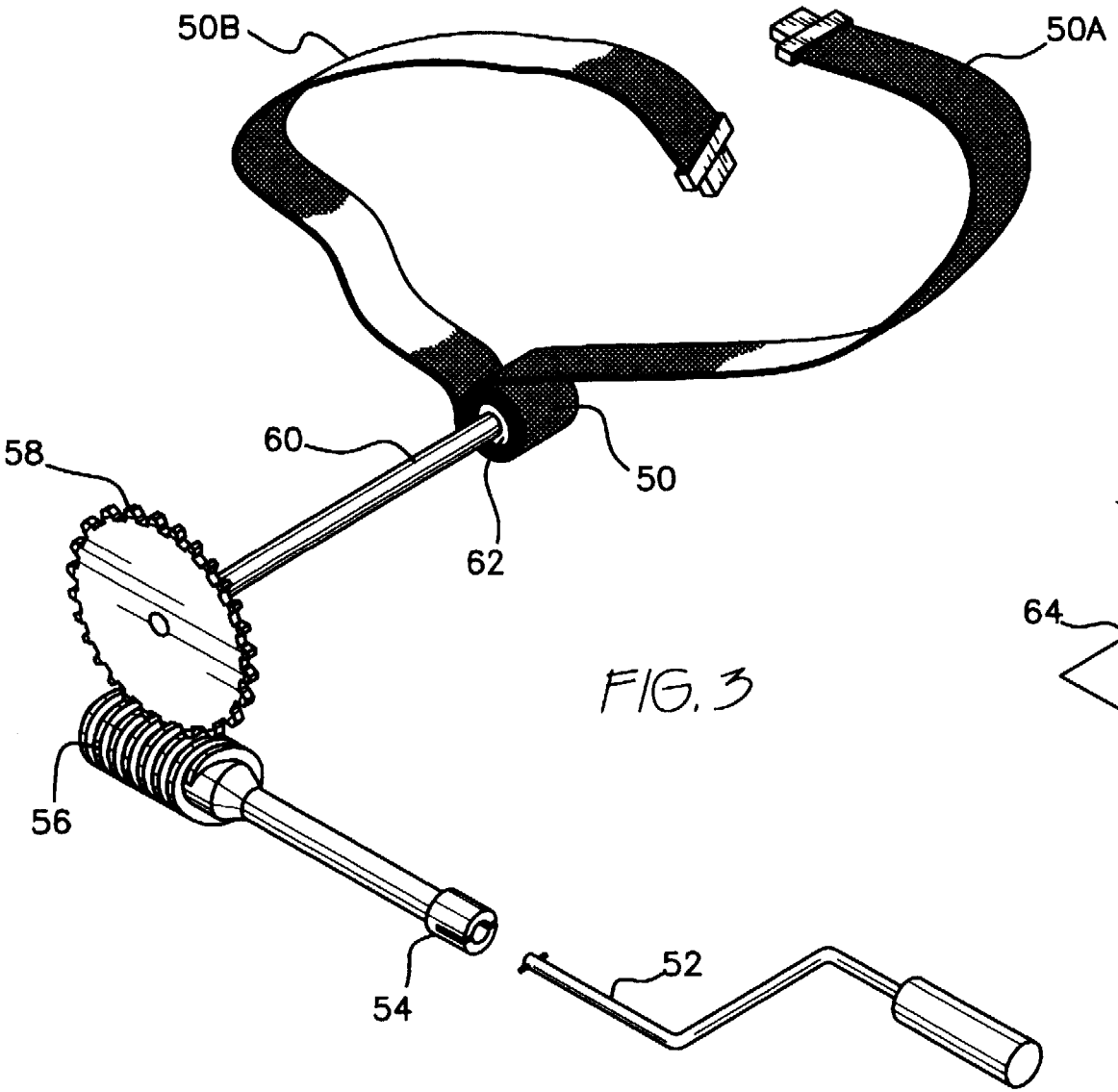
FIG. 3 is a perspective detail view of components shown at the right of FIG. 2.

Seatbelt assembly 48 is arranged to pay out and retract seatbelt 50 evenly from the right and left sides of the user, so as to maintain the user squarely seated, and not to twist the torso relative to the pelvis, especially when tightening the belt. FIG. 3 shows components of the seatbelt assembly 48 isolated from the rest of machine 10 for clarity.

A crank handle 52, which is preferably removable from machine 10 for compactness, is inserted into a socket 54. Socket 54 connects in turn to a worm gear 56. A gear 58 is driven by worm gear 56, and is in turn connected by shaft 60 to a reel 62. Seat belt 50 is wound around reel 60 such that right and left portions 50A, 50B of seat belt 50 pay out from the same side of reel 62. A fixed guide (not shown) may be provided to assure that seat belt 50 feeds and retracts in an orderly fashion, and does not bind or become misdirected.

Figure 4:
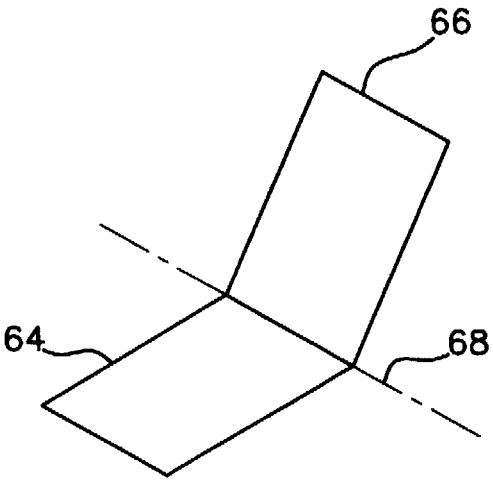
FIG. 4 is a diagrammatic representation of the seat formed by the present invention.

Forward inclination of seatback assembly 22 will now be discussed. First, it will be appreciated that seatback assembly 22 in combination with seat assembly 12 define two critical planes. Referring now to FIG. 4, the first critical plane 64 is that associated with support of the buttocks and legs of the user. This need not literally be a plane, for as shown in FIG. 1, the user's legs may occupy a different plane than do the thighs or the buttocks. However, this plane 64 is representative of a generally horizontal surface on which the buttocks, thighs, legs, and feet are supported from below.

The plane 66 of the back intersects plane 64 along a horizontal axis 68 of pivot. Axis 68 generally coincides with an imaginary point 70 (see FIG. 1) located toward the rear of seat cushion 16. As in the case of plane 64, plane 66 need not be literally planar, as the human back has a curved surface, and cushions 18 and 24 will yield to the back under pressure.

Figure 5:
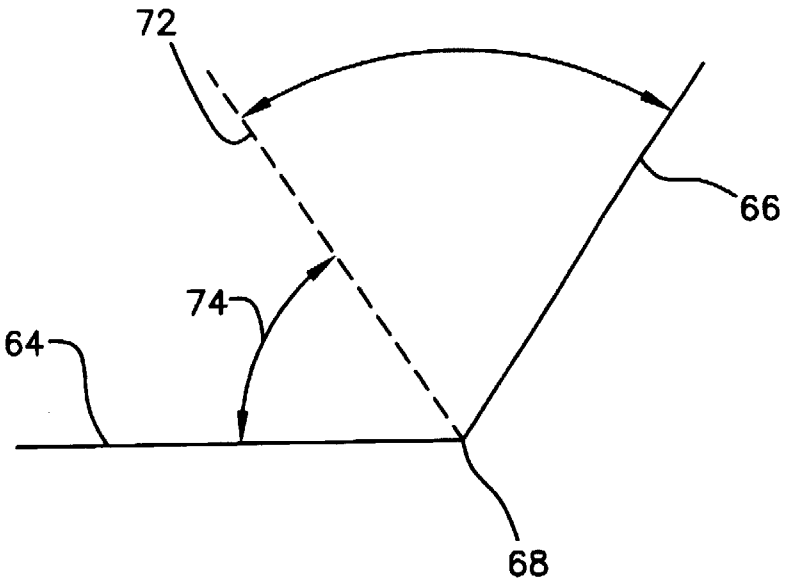
FIG. 5 is a diagrammatic representation showing limits of travel of elements of the seat shown in FIG. 4.

Machine 10 is arranged so that seatback assembly 22 can be upright or vertical, but preferably can incline backwardly as shown in FIG. 5. The extent of oscillation about axis 68 is indicated diagrammatically in FIG. 5, an extreme forwardly inclined position of seatback assembly being indicated at 72. Forwardly inclined signifies that resultant angle 74 formed between planes 64 and 66 is acute. It will be appreciated that any arbitrary reference point located on seatback assembly 22 will sweep through a vertical plane when seatback assembly 22 moves through its travel. In this sense, seatback assembly 22 may be said to pivot relative to its anchorage at seat assembly 12 in a vertical plane.

Figure 6:
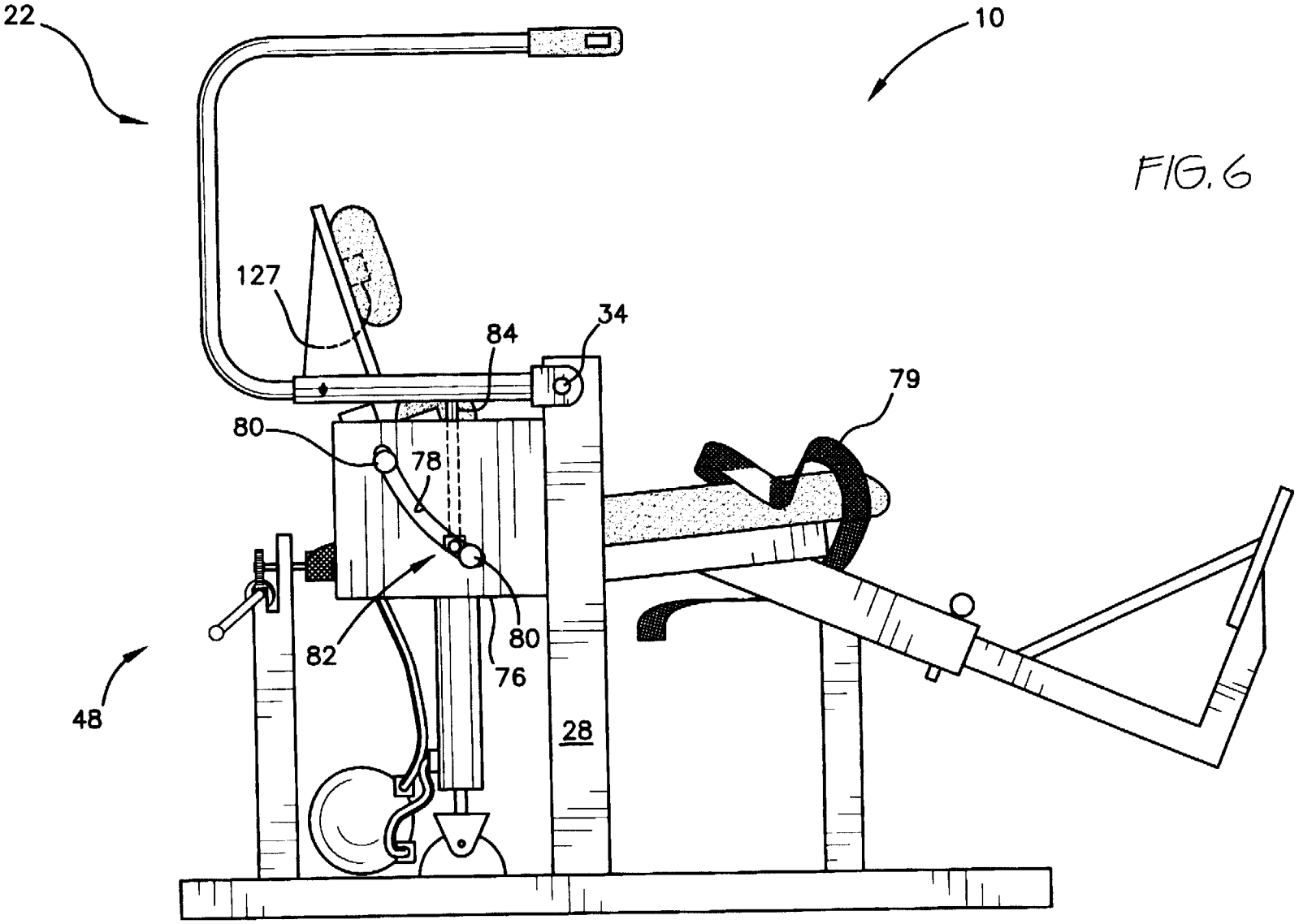
FIG. 6 is a right side elevation detail view of the invention.

Limits of angular travel or of arcuate motion of seatback assembly 22 relative to said seat assembly 12 are adjusted prior to use of machine 10. Method of and apparatus for this adjustment are shown in FIG. 6. A plate 76 fixed to the frame of machine 10 has an arcuate slot 78 formed therein. Adjustable stops 80 are located at opposite ends of slot 78, and are positioned to limit travel of seatback 22. A switch 82 fixed is disposed at the end of an arm 84 fixed to seatback assembly 22 to coincide with slot 78 such that as seatback 22 oscillates about axle 34, switch 82 is constantly aligned with slot 78.

FIG. 6 also shows a knee restraint 79, for preventing the user's legs from bending at the knee, thereby defeating effectiveness of machine 10. Rather, leg restraint 79 assures that the user cannot roll on cushion 16 (see FIG. 1) on his or her buttocks, and assures that intended movements of the body as it bends at the pelvis are actually accomplished. After the user's legs are arranged for comfort with his or her feet supported on footrest 20, restraint 79 is secured in place. In this scheme, footrest 20 is stationary after initial adjustment, and restraint 79 is adjusted to suit foot position. Restraint 79 may be a belt as illustrated, a cushion fixed to machine 10 (the latter embodiment of restraint 79 is not shown), or any other arrangement for preventing the legs from flexing. Restraint 79 may be secured by a ratchet arrangement (not shown), or by any suitable locking scheme.

Figure 7:
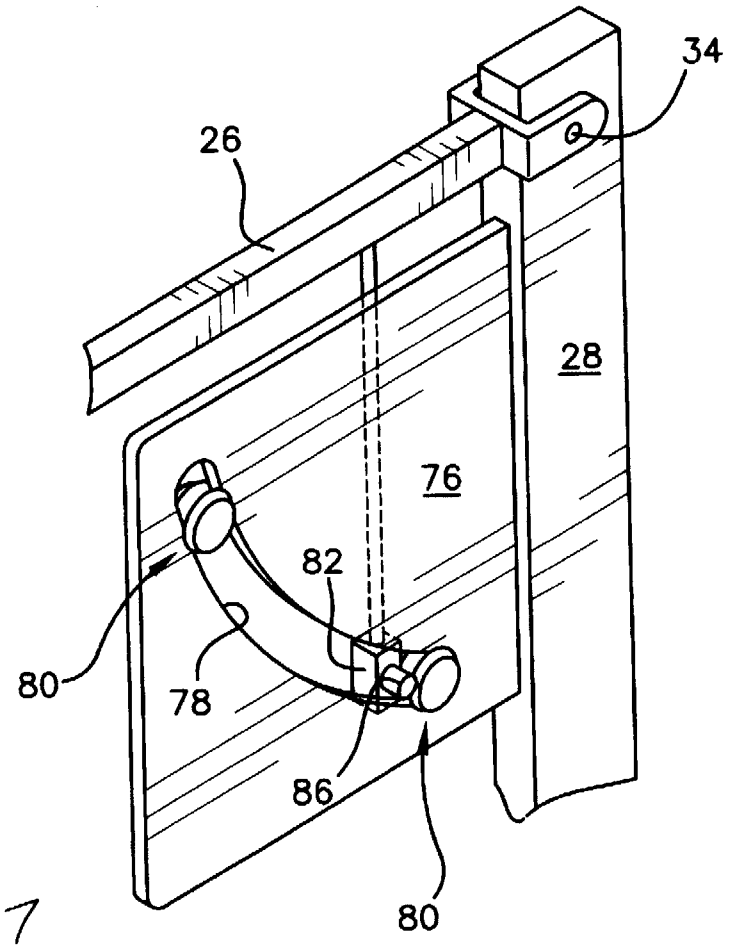
FIG. 7 is an enlarged, perspective detail view of components shown in FIG. 6.

Turning now to FIG. 7, switch 82 is seen to have a projecting trip bar 86 passing through slot 78. As switch 82 approaches a stop 80, trip bar 86 contacts stop 80 and generates a reversing signal. The reversing signal reverses direction of operation of the hydraulic drive, which will then proceed until trip bar 86 contacts the other stop 80. Therefore, one stop 80 contacts trip bar 86 at one end of arcuate motion of seatback assembly 22, and the other stop 80 contacts trip bar 86 at the other end of arcuate motion of seatback assembly 22. Location of stops 80 on plate 76 thus determine angular limits of travel or oscillation of seatback assembly 22.

In this view, stops 80 are each seen to comprise complementary nut and bolt. The complementary parts are loosened and positioned at a desired location along slot 78, then tightened. Each stop is positioned independently of the other, so that extreme rear and forward inclination may be varied as desired.

Figure 8:
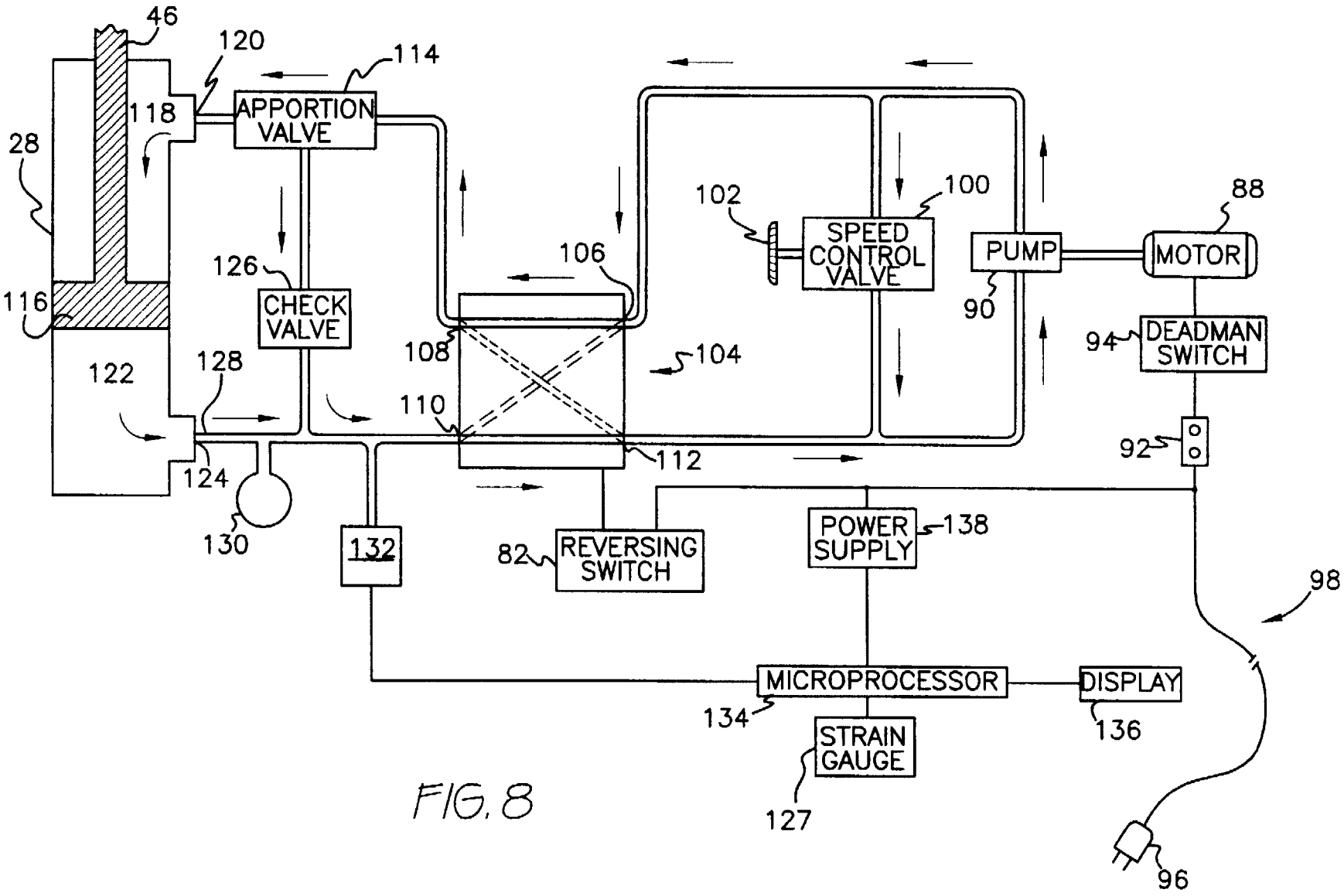
FIG. 8 is a combined electrical and hydraulic schematic diagram of the invention.

FIG. 8 shows a simplified diagram of the hydraulic and electrical circuits for machine 10. Motor 88 operates hydraulic pump 90 responsive to on-off switch 92 and dead man switch 94 both being in an electrically closed position. Motor is of a predetermined power such that it will develop force greater than that of a person, so that seatback 22 will be moved regardless of resistance by the user.

Dead man switch 94 is preferably mounted on one handgrip 32 (see FIG. 1), so that minimal effort is required by the user to bring about a rapid shutdown if required. Since pain or other incapacitation could be a condition requiring shutdown, it is preferred that a passively operated device such as dead man switch 94 is employed for this purpose rather than a switch requiring conscious or continuous effort or contact.

Power is shown representatively as originating at a plug 96 of a plug and cord assembly 98. Any suitable power source and connection may be provided, such as permanent wiring requiring tools to connect and disconnect, battery, and still others.

Again considering the hydraulic circuit, pump 90 forces hydraulic fluid in the direction indicated by arrows. A speed control valve 100 enables recirculation of a small portion of hydraulic fluid for governing speed of travel of seatback assembly 22 (see FIG. 1). Speed control valve 100 is manually controlled by knob 102.

Fluid not recirculated by valve 100 proceeds through a reversing valve 104. Valve 104 is a four port, two position valve in which two separated passages are alternatively connected to opposite outlets. As shown in solid lines, fluid passes from port 106 to port 108, and from port 110 to port 112. In the reversed condition, port 106 would communicate with port 110, and port 108 with port 112, as indicated in broken lines.

Fluid exiting port 108 passes to an apportioning valve 114 which recirculates a predetermined volume of fluid. This is required in some cases since rod 46 associated with ram 38 occupies some volume above piston 116 of ram 38. Since there is no corresponding structure occupying space below piston 116, a given volume of injected fluid will move piston 116 further than would a similar volume of fluid injected below piston 116. Valve 114 makes necessary compensation to assure that at constant pumping speed, piston 116 and associated rod 46 move at identical speed in both forward and reverse directions.

Given the arrangement illustrated in FIGS. 1 and 2, upward motion of piston 116 inclines seatback 22 forwardly (see FIG. 2), and downward motion of piston 116 returns seatback 22 to its original position. When switch 82 (see FIG. 6) reverses direction of the hydraulic system, valve 104 operates as described above. It will be seen that the hydraulic circuit does not constitute a closed loop. Rather, fluid which has entered the upper chamber 118 of ram 38, that is, above piston 116, periodically exits through entry port 118. Similarly, fluid occupying lower chamber 122 exits through entry port 124.

When ram 38 is moving seatback assembly forwardly, in the exercising and rehabilitation mode for lower back muscles, fluid flow will generally be opposite that indicated by arrows of FIG. 8. However, fluid will not pass through check valve 126, since the apportioning feature operates only when lowering seatback assembly 22 in the arrangement depicted in FIGS. 1 and 2.

In the exercising and rehabilitation modes, it is desired to sense and communicate effort exerted by the user. This may be accomplished by locating a strain gauge 127 behind cushion 24 (see FIG. 1) and the structural member supporting cushion 24. Signals resulting from strain gauge 127 are transmitted to a microprocessor 134.

A second way of gauging effort is to monitor pressure developed within the hydraulic circuit. In the embodiment depicted throughout the drawing figures, this method is not fully reliable, since a person pulling downwardly on arm 30 will increase resistance to upward motion of ram 38. This increase in pressure will be read as increased effort on the part of the user, which would not reflect actual effort of back muscles.

However, if the user does not impose his or her weight on arm 30, then pressure existing within conduit 128 will be indicative of effort of resistance by the user. This pressure is sensed and indicated by a visual pressure gauge 130, or preferably is employed by a transducer 132 to generate a variable signal indicative of pressure, which signal is then transmitted to microprocessor 134. Microprocessor 134 processes data from the signal to generate a display signal, which is indicated by display 136. It will be seen that electrical functions are powered directly from plug and cord assembly 98, or if DC power is required, through a suitable converter or power supply 138.

Display 136 may be of any suitable type providing an output in sensible form, such as visual, audible, and, if desired, tactile. For example, display 136 may be a liquid crystal display, or may contain a variable tone buzzer or voice synthesizer which audibly indicates pressure or information inferred from the pressure signal of transducer 132. Display 136 is representative of any desired type of device for visually or audibly indicating information, and will be understood to include necessary auxiliary components such as drivers, voice synthesizer, and other components required for the selected type of display.

A person trained on machine 10, a therapist, assists in preparing machine 10 for use. In particular, the therapist must be familiar with the characteristics of machine 10 as well as with rehabilitational and developmental physiology of potential users. The therapist installs the user in seat assembly 12, tightening belt 50 appropriately. With buttocks seated on cushion 16, the user's pelvis and weight of his or her torso are supported. The user's feet rest on footrest 20. Seat assembly 12 therefore supports the pelvis and legs of a user in a constant, seated position.

Certain dimensions of machine 10 are adjusted to the body dimensions of the user. Referring again to FIG. 1, arm 30 is slidably received within arm 26, and locked in a particular position by a thumbscrew 140. This arrangement adjusts distance of each handgrip 32 at seatback assembly 22, so that hand position of a user is comfortably located.

Similarly, footrest member 142 is slidably received within socket 144 of the frame of machine 10. A pin 146 passes through aligned holes formed in member 142 and socket 144 to lock footrest 20 in a position suitably distant from seatback assembly 22 for comfort of the user.

Angular adjustments are made so that the effort of resistant is made over a path of travel felt advantageous for the individual user. Considering the condition of the user and the purpose of the exercise, the latter encompassing increase in strength, increase in stamina, or rehabilitation, the therapist determines path of travel, employing stops 80, travel velocity employing speed control valve 100, and number of exercise repetitions. It is contemplated that for injured persons undergoing rehabilitation, travel distance will be minimal, and will be increased in subsequent episodes of use.

The user, the therapist, or a third party keeps track of the number of exercise repetitions. If microprocessor 134 is programmed to count repetitions, the number thereof may be indicated by display 136.

For his or her part, the user resists travel of seatback 22 to the degree recommended by the therapist. The user grasps right and left handles 32 in a manner assuring that dead man switch 94 be depressed. If exercising causes or is accompanied by acute pain or must be interrupted for any other reason, releasing handles 32 will cause motor 88 to stop. Continued movement of seatback 22 will be immediately arrested.

The invention is susceptible to variations and modifications which will occur to one of skill in the art. For example, the hydraulic system could be replaced by a motorized cable system or a motorized screw system. Reversal may be accomplished by reversing motor 88 rather than by rerouting fluid. In a fluid system, pump 90 would be of the reversible type.

Any number of described and additional functions may be automated, or placed under the control of microprocessor 134, if sufficient sensors and controls were incorporated.

The pelvic restraint system may incorporate a rigid bar, preferably cushioned, lowered over the pelvis in place of a flexible belt.

It is to be understood that the present invention is not limited to the embodiments described above, but encompasses any and all embodiments within the scope of the following claims.

I claim:

1. A conditioning machine for the lower back, comprising:

a frame including a base for supporting said conditioning machine on a horizontal surface;

a seat assembly fixed to said frame, having means for supporting the pelvis and legs of a user in a fixed, seated position;

a seatback assembly having powered drive means connected to said seatback assembly, for compelling the torso of the user to incline pivotally in a forward direction from a vertical seated position regardless of resistance applied by the user, said drive means having a motor operably connected to said drive means, said motor having means for developing force greater than that of a person, whereby said drive means compels a person resisting said seatback assembly to incline forwardly regardless of effort of resistance by the person, said seatback assembly having a horizontal axis of pivot, said seatback assembly further comprising anchoring means for anchoring said seatback assembly to said seat assembly pivotally about said horizontal axis, and for constraining said seatback assembly to pivot relative to said seat assembly in a vertical plane, said seatback assembly further comprising a right handgrip solidly fixed to said seatback assembly and a left handgrip solidly fixed to said seatback assembly, whereby a user's arms and hands may be supported in a constant position relative to the user's torso when using said conditioning machine, said drive means comprising a hydraulic power circuit having a double acting hydraulic servo powered by said motor and fluid conduits conducting fluid flowing within said hydraulic power circuit, said drive means further comprising drive control means for independently adjusting upper and lower limits of motion as said seat assembly pivots about said horizontal axis, said controls operating by interference between relatively moving components of said conditioning machine, and means for adjusting angular limits of arcuate motion of said seatback assembly relative to said seat assembly, comprising a reversing switch having a trip bar and mounted to said seatback assembly, and a first stop and a second stop each adjustably and independently mounted to said frame and disposed to contact said trip bar of said reversing switch during inclination of said seatback assembly and to generate a signal for reversing said motor, said first stop contacting said trip bar at one end of arcuate motion of said seatback assembly and said second stop contacting said trip bar at the other end of arcuate motion of said seatback assembly, said conditioning machine further having circuitry for transmitting said signal to said motor.

2. The conditioning machine according to claim 1, further comprising a dead man switch mounted upon at least one of said right handgrip and said left handgrip and operably connected to said motor, whereby relaxation of grasp by a user causes said seat back assembly to stop moving.

3. The conditioning machine according to claim 1, further comprising means for adjusting distance of said right handgrip and said left handgrip at said seatback, whereby hand position of a user may be adjusted for accommodating users of different body dimensions.

4. The conditioning machine according to claim 1, said seat assembly further comprising a footrest and means for adjusting distance of said footrest from said seat assembly, whereby foot position of a user may be adjusted for accommodating users of different body dimensions.

5. The conditioning machine according to claim 1, further comprising sensing means for sensing and indicating force acting on said seatback assembly, whereby muscular effort of a user may be ascertained.

6. The conditioning machine according to claim 5, said sensing means further comprising transducer means for generating data signals responsive to said force acting on said seatback assembly, said conditioning machine further comprising a microprocessor operably connected to said transducer means and a display operably connected to said microprocessor, whereby data signals corresponding to said force acting on said seatback assembly are generated by said sensing means and transmitted to said microprocessor, said microprocessor generates signals for indicating information, and said display converts said signals to a sensible form.

7. The conditioning machine according to claim 1, said hydraulic power circuit further comprising a strain gauge disposed in fluid communication with said fluid conduits, for sensing and displaying force developed within said hydraulic power circuit, thereby indicating muscular effort of a user.

8. A conditioning machine for the lower back, comprising:

a frame including a base for supporting said conditioning machine on a horizontal surface;

a seat assembly fixed to said frame, having means for supporting the pelvis and legs of a user in a fixed, seated position;

a seatback assembly having powered drive means connected to said seatback assembly, for compelling the torso of the user to incline pivotally in a forward direction from a vertical seated position regardless of resistance applied by the user, said drive means having a motor operably connected to said drive means, said motor having means for developing force greater than that of a person, whereby said drive means compels a person resisting said seatback assembly to incline forwardly regardless of effort of resistance by the person, said seatback assembly having a horizontal axis of pivot, said seatback assembly further comprising anchoring means for anchoring said seatback assembly to said seat assembly pivotally about said horizontal axis, and for constraining said seatback assembly to pivot relative to said seat assembly in a vertical plane, said seatback assembly further comprising a right handgrip solidly fixed to said seatback assembly and a left handgrip solidly fixed to said seatback assembly, whereby a user's arms and hands may be supported in a constant position relative to the user's torso when using said conditioning machine;

a dead man switch mounted upon at least one of said right handgrip and said left handgrip and operably connected to said motor, whereby relaxation of grasp by a user causes said seat back assembly to stop moving;

said drive means comprising a hydraulic power circuit having a double acting hydraulic servo powered by said motor, fluid conduits conducting fluid flowing within said hydraulic power circuit, and control means for independently adjusting upper and lower angular limits of arcuate motion of said seatback assembly relative to said seat assembly, said control means comprising a reversing switch having a trip bar and mounted to said seatback assembly, and a first stop and a second stop each adjustably and independently mounted to said frame and disposed to contact said trip bar of said reversing switch during inclination of said seatback assembly and to generate a signal for reversing said motor, said first stop contacting said trip bar at one end of arcuate motion of said seatback assembly and said second stop contacting said trip bar at the other end of arcuate motion of said seatback assembly, said conditioning machine further having circuitry for transmitting said signal to said motor; and a pelvic restraint comprising a flexible belt having a right portion anchored to said seat assembly and a left portion anchored to said seat assembly, and belt control means for feeding and retracting said flexible belt evenly from the right and left sides of said seat assembly.

9. The conditioning machine according to claim 1, further comprising an arm pivotally fixed to said frame and having a handle disposed thereon such that said handle is located above the user's head.

10. A conditioning machine for the lower back, comprising:

a frame including a base for supporting said conditioning machine on a horizontal surface;

a seat assembly fixed to said frame, having means for supporting the pelvis and legs of a user in a fixed, seated position;

a seatback assembly having powered drive means connected to said seatback assembly, for compelling the torso of the user to incline pivotally in a forward direction from a vertical seated position regardless of resistance applied by the user, said drive means having a motor operably connected to said drive means, said motor having means for developing force greater than that of a person, whereby said drive means compels a person resisting said seatback assembly to incline forwardly regardless of effort of resistance by the person, said seatback assembly having a horizontal axis of pivot, said seatback assembly further comprising anchoring means for anchoring said seatback assembly to said seat assembly pivotally about said horizontal axis, and for constraining said seatback assembly to pivot relative to said seat assembly in a vertical plane, said seatback assembly further comprising a right handgrip solidly fixed to said seatback assembly and a left handgrip solidly fixed to said seatback assembly, whereby a user's arms and hands may be supported in a constant position relative to the user's torso when using said conditioning machine, said drive means comprising a hydraulic power circuit having a double acting hydraulic servo powered by said motor and fluid conduits conducting fluid flowing within said hydraulic power circuit, said drive means further comprising drive control means for independently adjusting upper and lower limits of motion as said seat assembly pivots about said horizontal axis, said controls operating by interference between relatively moving components of said conditioning machine, and a pelvic restraint including a flexible belt having a right portion anchored to said seat assembly and a left portion anchored to said seat assembly, and belt control means, located behind and out of reach of an occupant of said seat assembly, for feeding and retracting said flexible belt evenly from the right and left sides of said seat assembly.

11. The conditioning machine according to claim 10, further comprising a dead man switch mounted upon at least one of said right handgrip and said left handgrip and operably connected to said motor, whereby relaxation of grasp by a user causes said seat back assembly to stop moving.

12. The conditioning machine according to claim 10, further comprising means for adjusting distance of said right handgrip and said left handgrip at said seatback, whereby hand position of a user may be adjusted for accommodating users of different body dimensions.

13. The conditioning machine according to claim 10, said seat assembly further comprising a footrest and means for adjusting distance of said footrest from said seat assembly, whereby foot position of a user may be adjusted for accommodating users of different body dimensions.

14. The conditioning machine according to claim 10, further comprising sensing means for sensing and indicating force acting on said seatback assembly, whereby muscular effort of a user may be ascertained.

15. The conditioning machine according to claim 14, said sensing means further comprising transducer means for generating data signals responsive to said force acting on said seatback assembly, said conditioning machine further comprising a microprocessor operably connected to said transducer means and a display operably connected to said microprocessor, whereby data signals corresponding to said force acting on said seatback assembly are generated by said sensing means and transmitted to said microprocessor, said microprocessor generates signals for indicating information, and said display converts said signals to a sensible form.

16. The conditioning machine according to claim 10, said hydraulic power circuit further comprising a strain gauge disposed in fluid communication with said fluid conduits, for sensing and displaying force developed within said hydraulic power circuit, thereby indicating muscular effort of a user.

17. The conditioning machine according to claim 10, said drive control means comprising a limit switch and electrical circuitry reversing said motor responsive to contact of said limit switch during interference between relatively movable components of said conditioning machine.

18. The conditioning machine according to claim 10, further comprising an arm pivotally fixed to said frame and having a handle disposed thereon such that said handle is located above the user's head.

* * * * *